US006076663A

United States Patent [19]

Shima

[11] Patent Number: 6,076,663

[45] Date of Patent: Jun. 20, 2000

[54] CARRIER FOR ACCUMULATING CONTAINERS

[75] Inventor: Kensuke Shima, Nara, Japan

[73] Assignee: Jefcom Co., Ltd., Osaka, Japan

[21] Appl. No.: 09/198,670

[22] Filed: Nov. 23, 1998

[51] Int. Cl.[7] ..... B65D 71/00

[52] U.S. Cl. ..... 206/216; 206/486; 206/499

[58] Field of Search ..... 206/216, 223, 206/575, 486, 499, 526

[56] References Cited

U.S. PATENT DOCUMENTS

| | | | |
|---|---|---|---|
| 4,690,271 | 9/1987 | Zak | 206/486 |
| 4,703,856 | 11/1987 | Chaussadas | 206/486 X |
| 4,785,953 | 11/1988 | Buchholz et al. | 206/526 X |
| 4,798,286 | 1/1989 | Muscanelli | 206/486 X |

*Primary Examiner*—Jacob K. Ackun

*Attorney, Agent, or Firm*—Koda & Androlia

[57] ABSTRACT

A carrier for holding a plurality of accumulating containers that accommodate small items. A plurality of fitting holes are formed in the flat-shaped carrier so that the shapes of the holes are substantially identical with the sectional shape of the accumulating containers in the periphery of their upper end portions, and respective accumulating containers are fitted to the fitting holes of the carrier such that at least a part of the main body of each one of the accumulating containers is exposed outside of the carrier. The carrier may alternatively be arranged by overlapping aperture sections of two flat-shaped box bodies with each other. The accumulating containers may be made so as to be transparent such that contents thereof are visible when the accumulating containers are held in the carrier, and the accumulating containers may also be made to be somewhat flexible such that they are hardly detachable from the fitting holes to which they have been fitted.

4 Claims, 20 Drawing Sheets

CARRIER FOR ACCUMULATING CONTAINERS

BACKGROUND OF THE INVENTION

1. Field of the Invention

The present invention relates to a carrier for holding a plurality of containers that accumulate various small items, such as screws, anchors or plugs, seeds of plants or buttons of clothing.

2. Prior Art

Conventionally, such a carrier for holding therein a plurality of accumulating containers is, as seen from FIG. 20, comprised of a carrier main body 20 and an opening/closing lid 21; and a plurality of accumulating containers 2, respectively formed, as shown in FIG. 19, of a container main body 2*a*, an opening/closing cover 2*b* and a clip 9 which is formed on the container main body 2*a* and used so that the container main body 2*a* covered by the lid 2*b* is freely attached to and detached from, for instance, a belt of a pair of trousers, are contained in the carrier main body 20 in an aligned manner as shown in FIG. 20. By closing the opening/closing lid 21 arranged at the carrier main body 20 and thus holding the accumulating containers 2 down by the inner surface of the opening/closing lid 21, the accumulating containers 2 are prevented from moving inside the carrier main body 20.

The conventional carrier for accumulating containers of the above described arrangement was advantageous in that the accumulating containers 2 could be stored on a shelf or in a warehouse while being held in the carrier main body 20, in that the accumulating container could be replaced so that only required accumulating containers 2 were held in the carrier, and in that the carrier could be conveniently carried around since the accumulating containers 2 were prevented from moving around in the carrier main body 20.

On the other hand, drawbacks were presented. If the accumulating containers 2 were transparent, the inside of the accumulating containers 2 could not be viewed if the opening/closing lid 21 of the carrier is closed unless the carrier main body 20 and opening/closing lid 21 of the carrier were also transparent. Thus, it had been difficult to determine the contents of the accumulating containers 2 stored in the carrier and to replace the accumulating containers 2 with other accumulating containers.

Further, since the above-described conventional carrier for accumulating containers was required to have an inner volume that is suitable to hold a number of accumulating containers 2, the carrier could be bulky and thus heavy; and as a result, the manufacturing costs could be high due to the increase in materials required for manufacturing the carrier.

SUMMARY OF THE INVENTION

Accordingly, the present invention is made for the purpose of solving the problems of the above described conventional carrier for accumulating containers It is an object of the present invention to provide a carrier for accumulating containers with which the contents of the accumulating containers can be viewed when the containers are transparent while the carrier main body or opening/closing lid of a carrier for the accumulating containers are not transparent, and with which a plurality of accumulating containers can be held in the carrier without requiring an inner volume for holding a plurality of accumulating containers therein.

In order to accomplish the above object, the carrier for accumulating containers according to the present invention is arranged so that a plurality of fitting holes are formed in a flat-shaped carrier so that the fitting holes have shapes substantially identical with the sectional shapes of accumulating containers in the periphery of the upper end portions of the containers, and respective accumulating containers are fitted to the fitting holes of the carrier such that at least a part of container main body of each of the accumulating containers is exposed outside the carrier.

Further, the carrier for accumulating containers according to the present invention may alternatively be arranged so that the carrier is comprised of two flat-shaped box bodies formed with aperture sections which are overlapped with respect to each other, a plurality of fitting holes are respectively formed on side plates of the box bodies so that the shapes of the fitting holes are substantially identical with the sectional shapes of the accumulating containers in the periphery of their upper end portions, and the accumulating containers are fitted to the fitting holes of the box bodies such that at least a part of the container main body of each one of the accumulating containers is exposed outside the box bodies and such that the opening/closing covers of the opposing accumulating containers are located close to each other.

The accumulating containers can be made so as to be transparent and somewhat flexible. In other words, they have an elasticity and are elastically engaged with the fitting holes, thus being fitted therein and held in the carrier (box body). In addition, protruding ribs may be formed around the periphery of the fitting holes.

Still further, the outer surfaces of the accumulating containers may be formed so as to assume tapered surfaces that expand from the bottom to the top, and the inner surface of the ribs may be arranged to assume tapered surfaces so as to correspond to the outer surfaces of the accumulating containers.

DETAILED DESCRIPTION OF THE PREFERRED EMBODIMENTS

Embodiments of the carrier for accumulating containers according to the present invention will be described in detail below with reference to the drawings.

As shown in FIGS. 1 to 4, a carrier 1 is flat-shaped, and a plurality of fitting holes 3 are formed in this flat-shaped carrier 1 so that the shapes of the holes 3 are substantially identical with the sectional shapes of the accumulating containers 2 in the periphery of their (containers') upper end portions. The accumulating containers 2 are respectively fitted to the fitting holes 3 of the carrier 1 such that at least a part of the container main body 2*a* of each one of the accumulating containers 2 is exposed outward (that is, exposed towards the left in FIGS. 2 and 4) of the carrier 1.

FIGS. 10 to 13 show another embodiment of the carrier for accumulating containers according to the present invention. In this embodiment, a carrier 1 is comprised of two flat-shaped box bodies 1' with aperture sections 1*a* of the box bodies 1 overlapped with respect to each other. A plurality of fitting holes 3 are respectively formed on side plates 1*b* of the box bodies 1' wherein the shapes of the fitting holes are substantially identical with the sectional shapes of the accumulating containers 2 in the periphery of their upper end portions. The accumulating containers 2 are fitted to the fitting holes 3 of the box bodies 1' such that at least a part of the container main body 2*a* of each one of the accumulating containers 2 is exposed outward of the box bodies 1' (that is, exposed toward the right and left in FIGS. 11 and 13) and such that opening/closing covers 2*b* of opposing accumulating containers 2 are respectively made to be approximate to each other.

Figure 5:
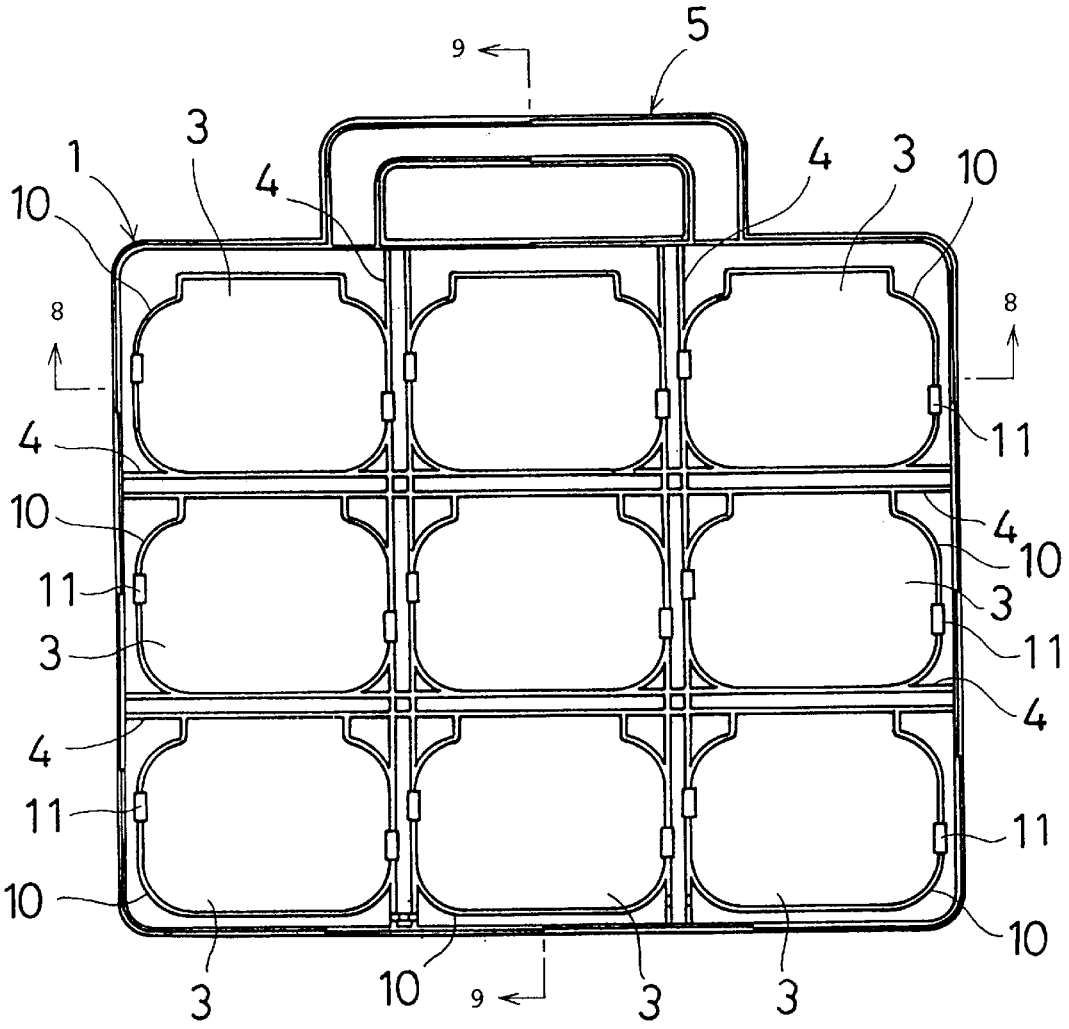
FIG. 5 shows the interior of the carrier for accumulating containers according to the present invention.
Figure 6:
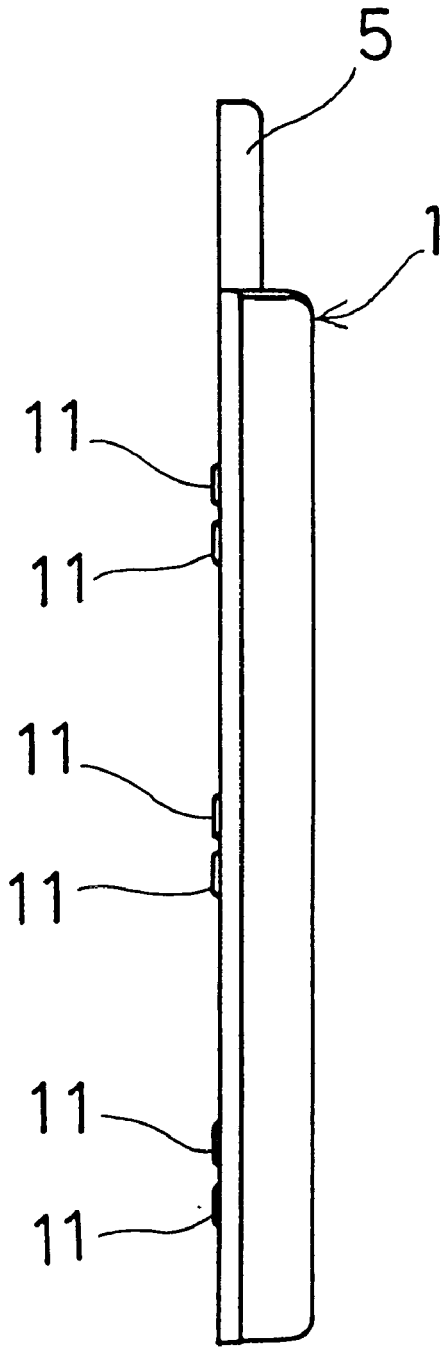
FIG. 6 is a side view of the carrier for accumulating containers according to the present invention.
Figure 7:
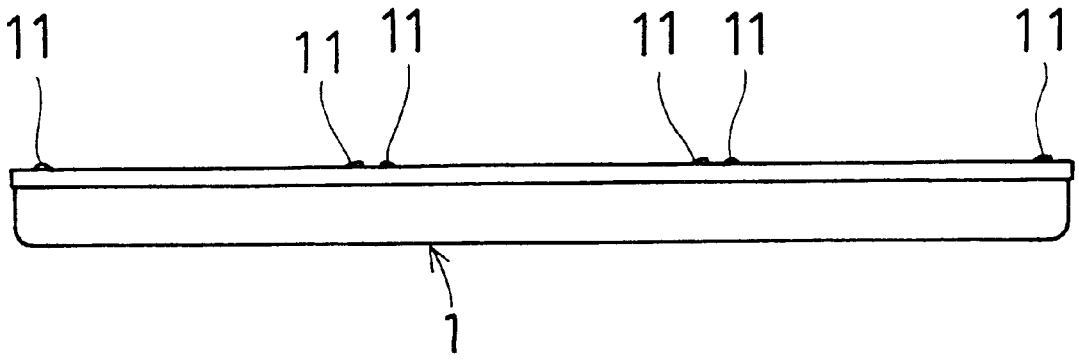
FIG. 7 is a bottom view thereof.
Figure 8:
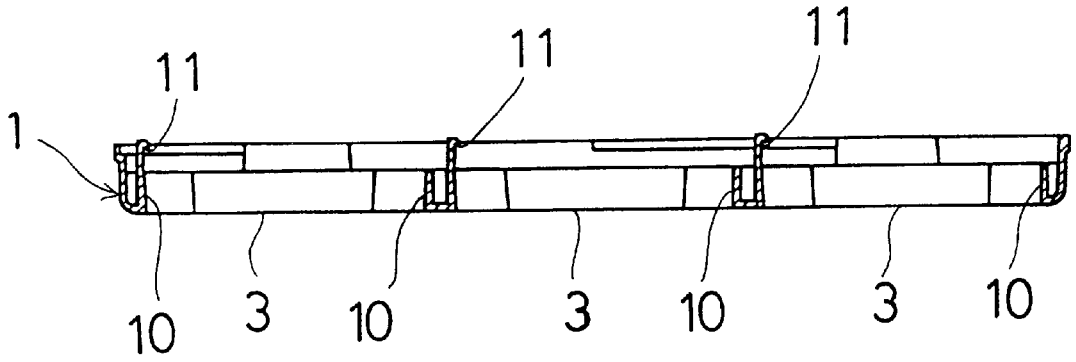
FIG. 8 is a sectional view taken along the line 8—8 in FIG. 5.
Figure 9:
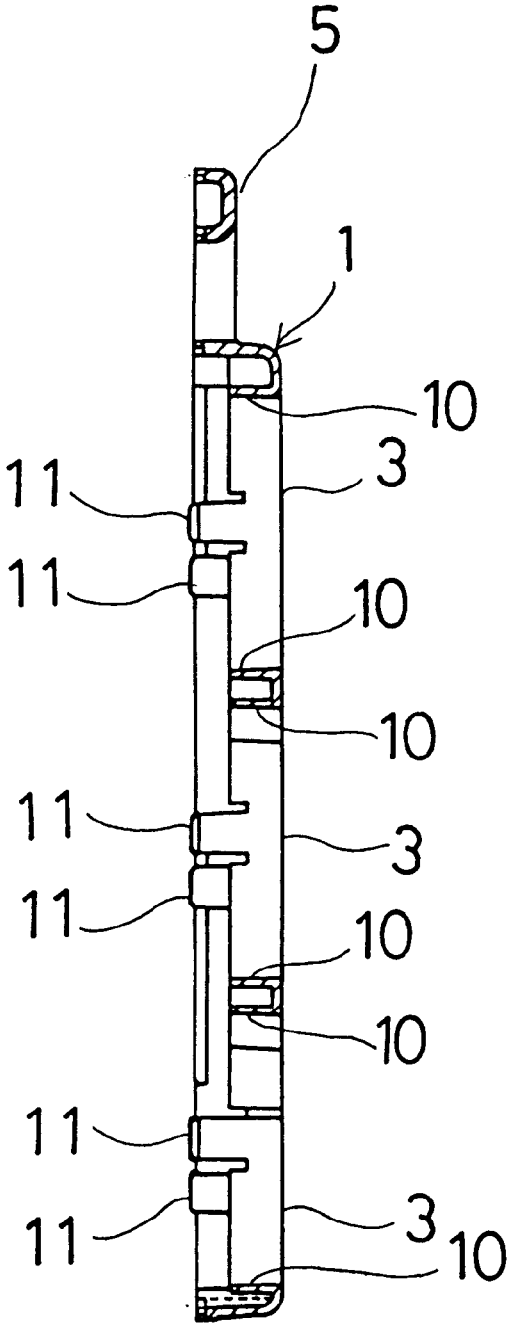
FIG. 9 is a sectional view taken along the line 9—9 in FIG. 5.
Figure 10:
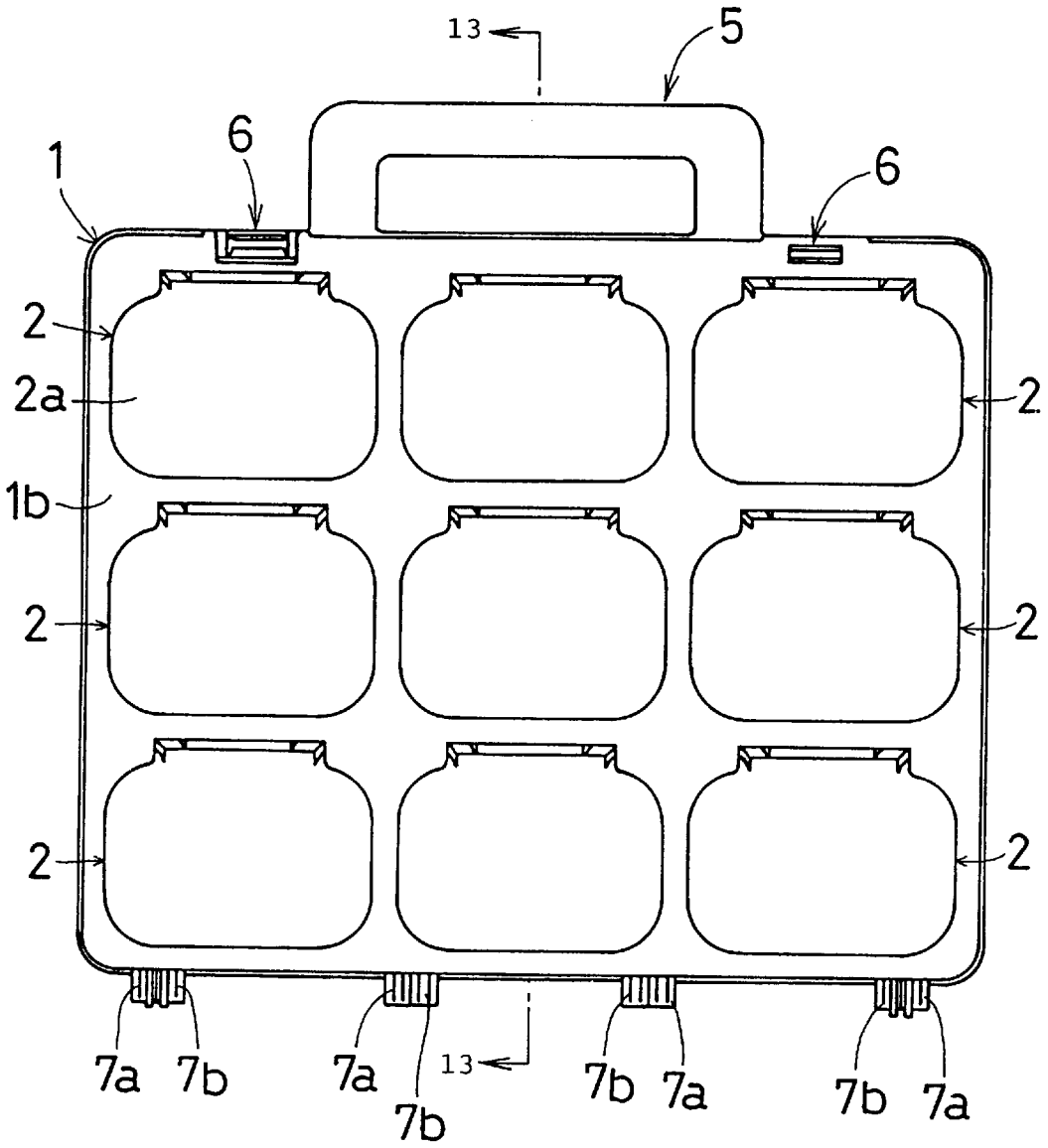
FIG. 10 is a front view of the carrier for accumulating containers according to the present invention, the carrier comprising two overlapped box bodies with accumulating containers held therein.
Figure 11:
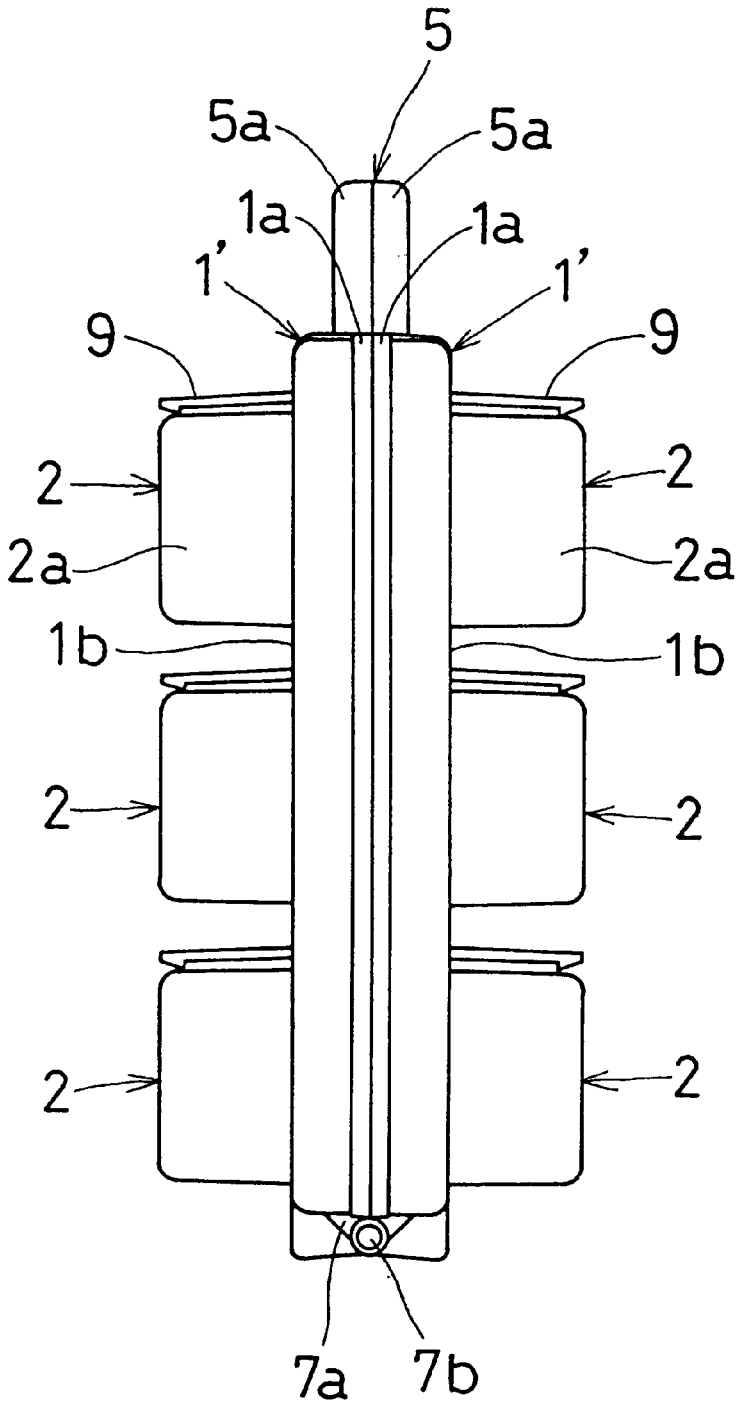
FIG. 11 is a side view thereof.
Figure 12:
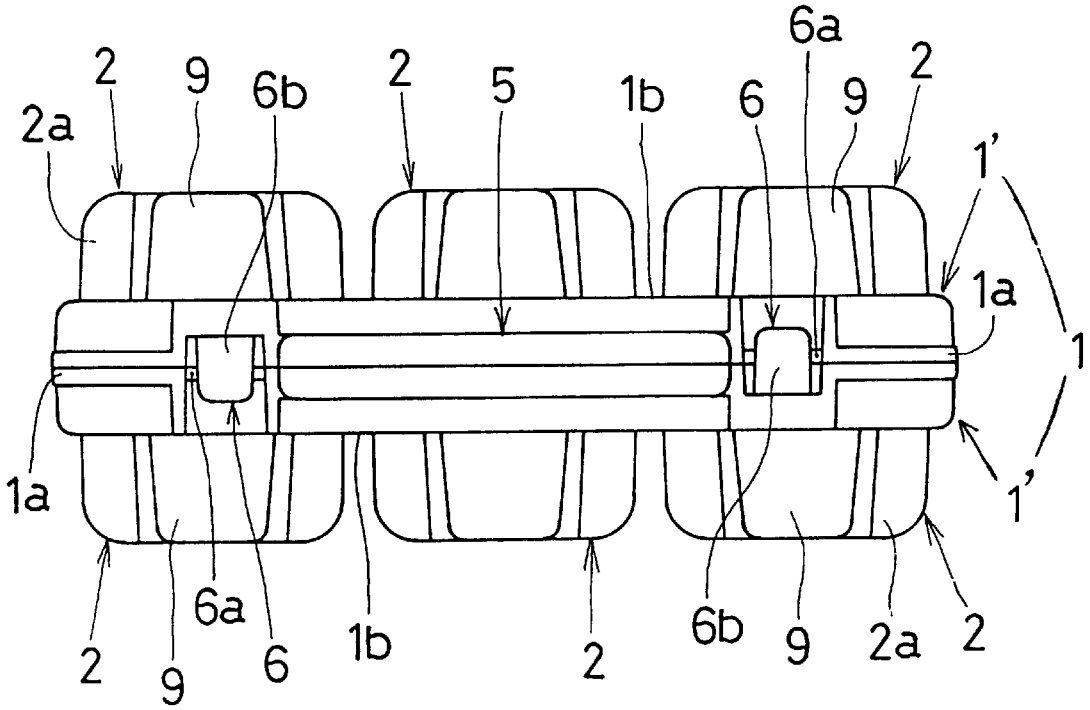
FIG. 12 is a top view thereof.
Figure 13:
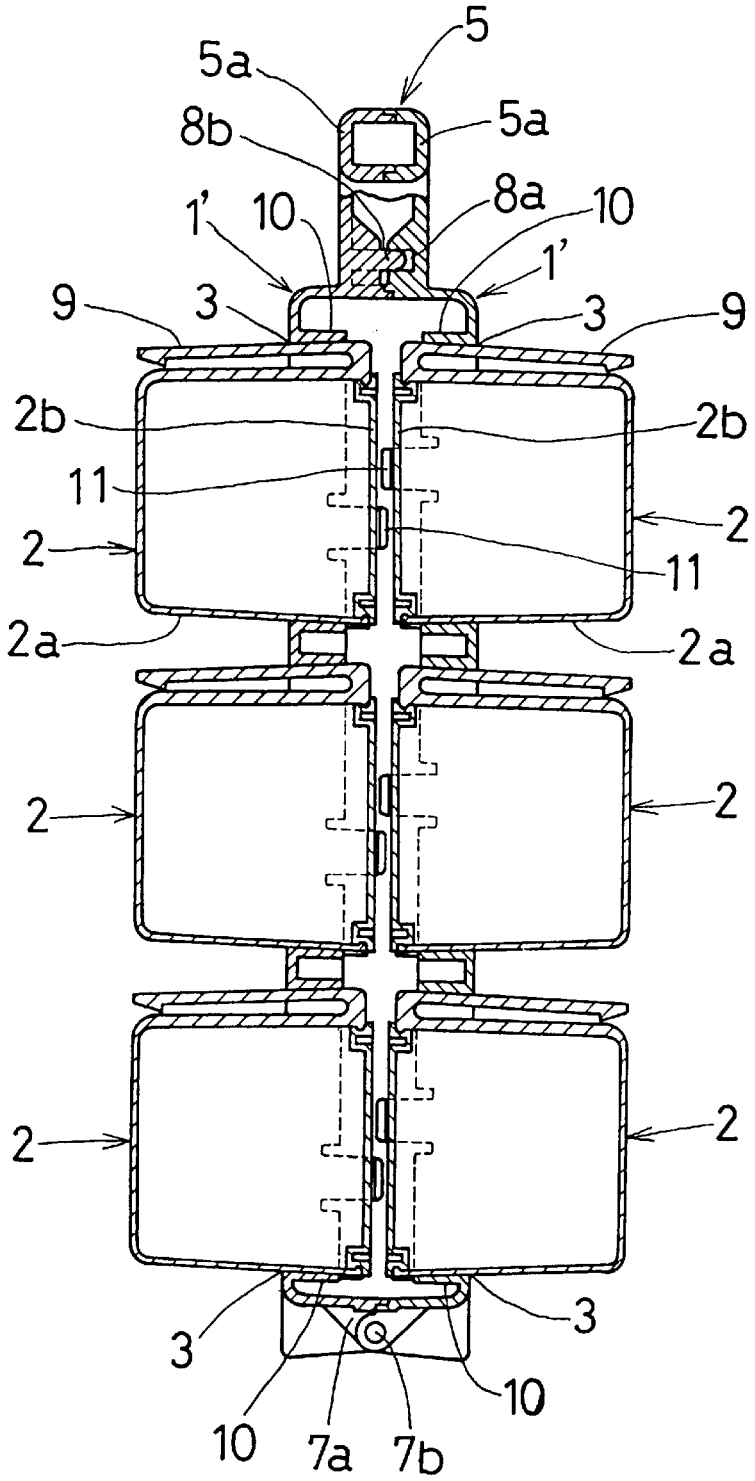
FIG. 13 is a sectional view taken along the line 13—13 in FIG. 10.
Figure 14:
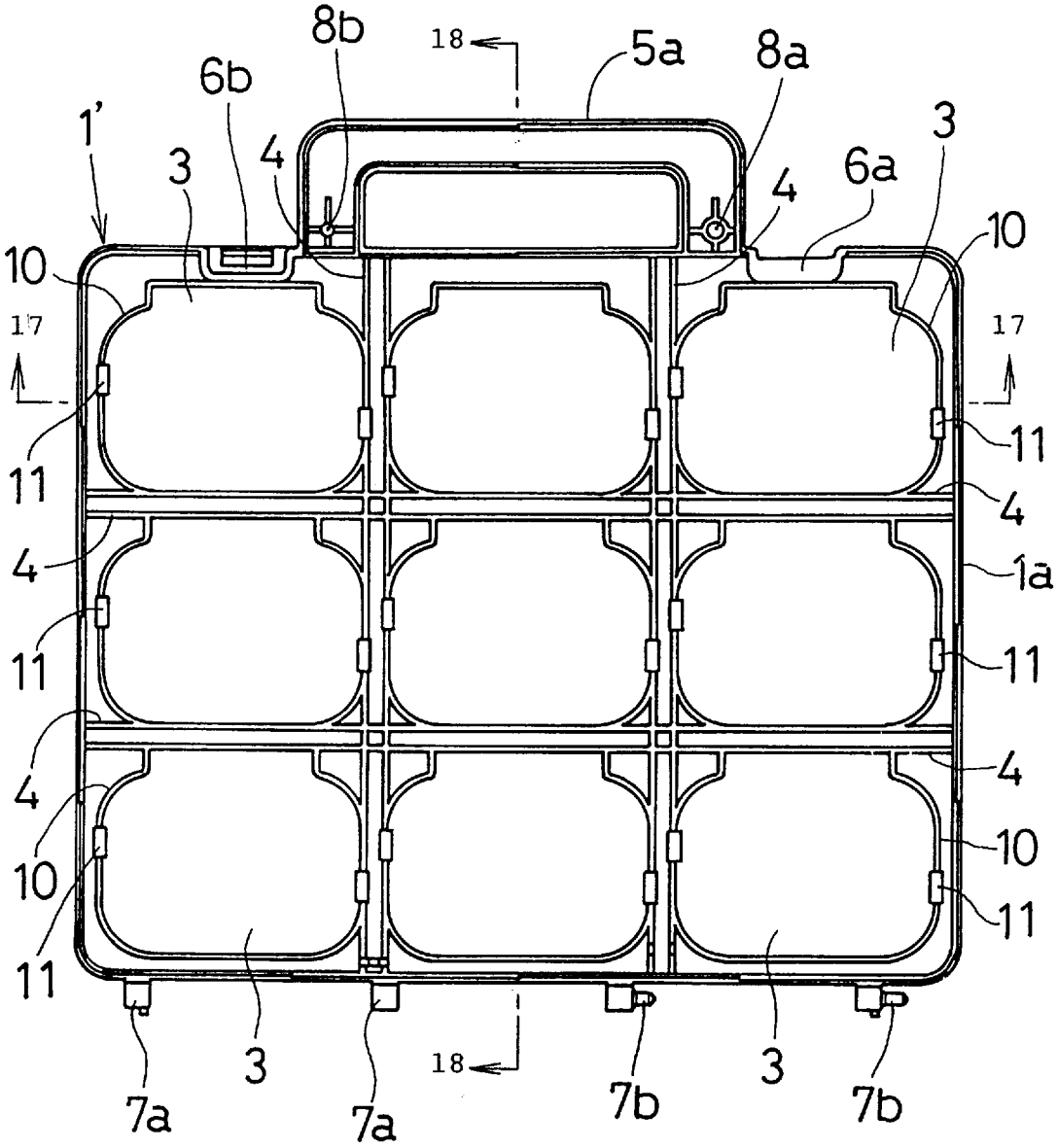
FIG. 14 shows the interior of one of the box bodies of the carrier for accumulating containers shown in FIG. 10.
Figure 15:
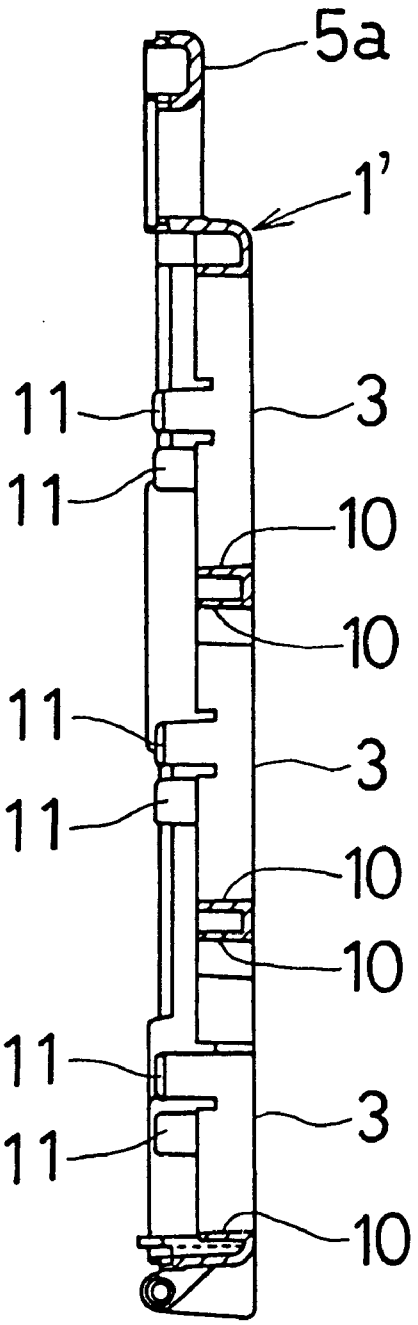
FIG. 15 is a side view of one of the box bodies of the carrier for accumulating containers.
Figure 16:
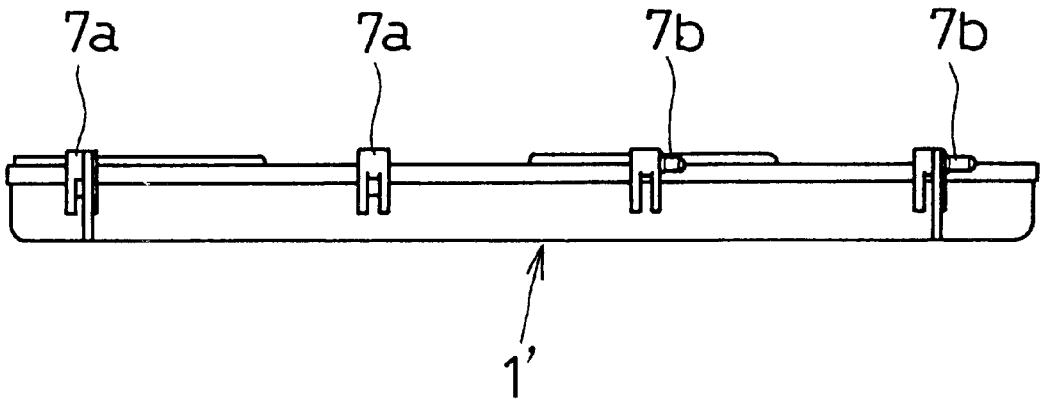
FIG. 16 is a bottom view thereof.
Figure 17:
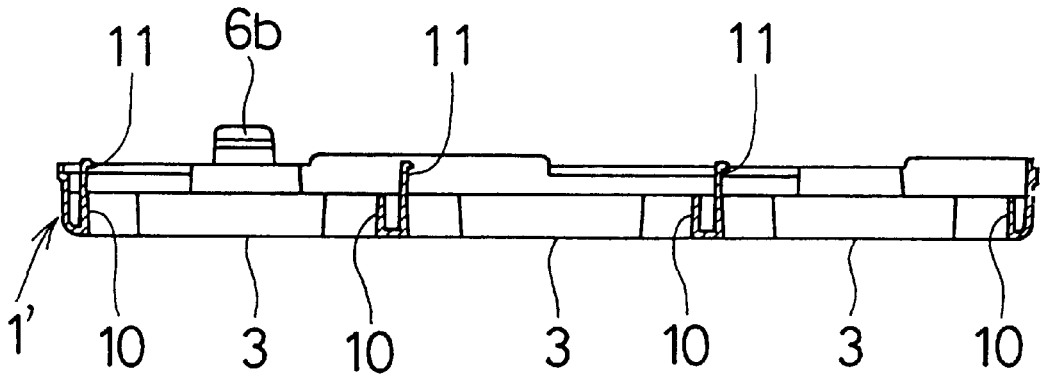
FIG. 17 is a sectional view taken along the line 17—17 in FIG. 14.
Figure 18:
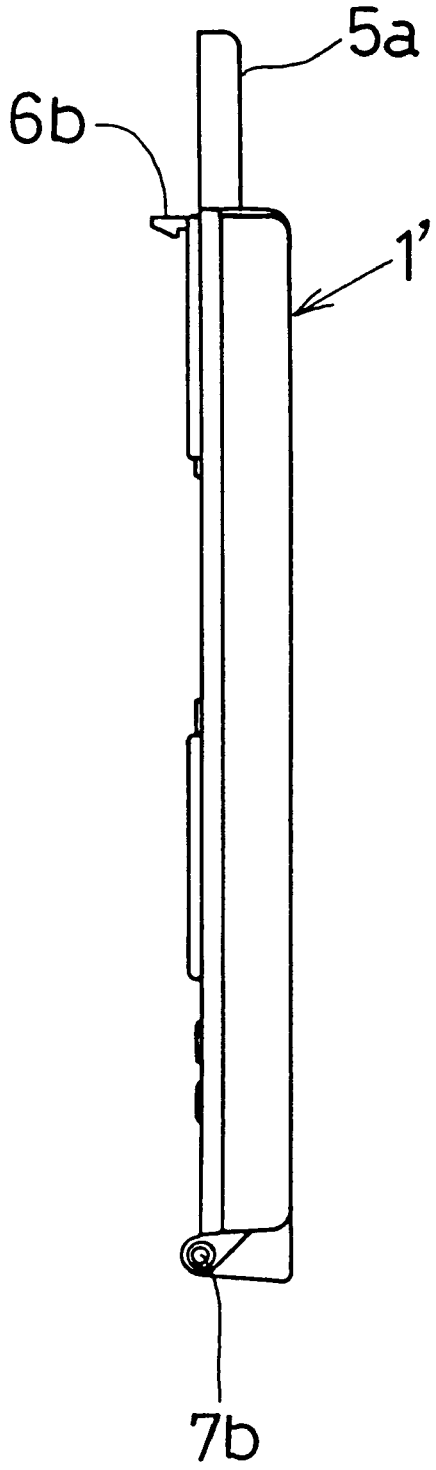
FIG. 18 is a sectional view taken along the line 18—18 in FIG. 14.
Figure 19:
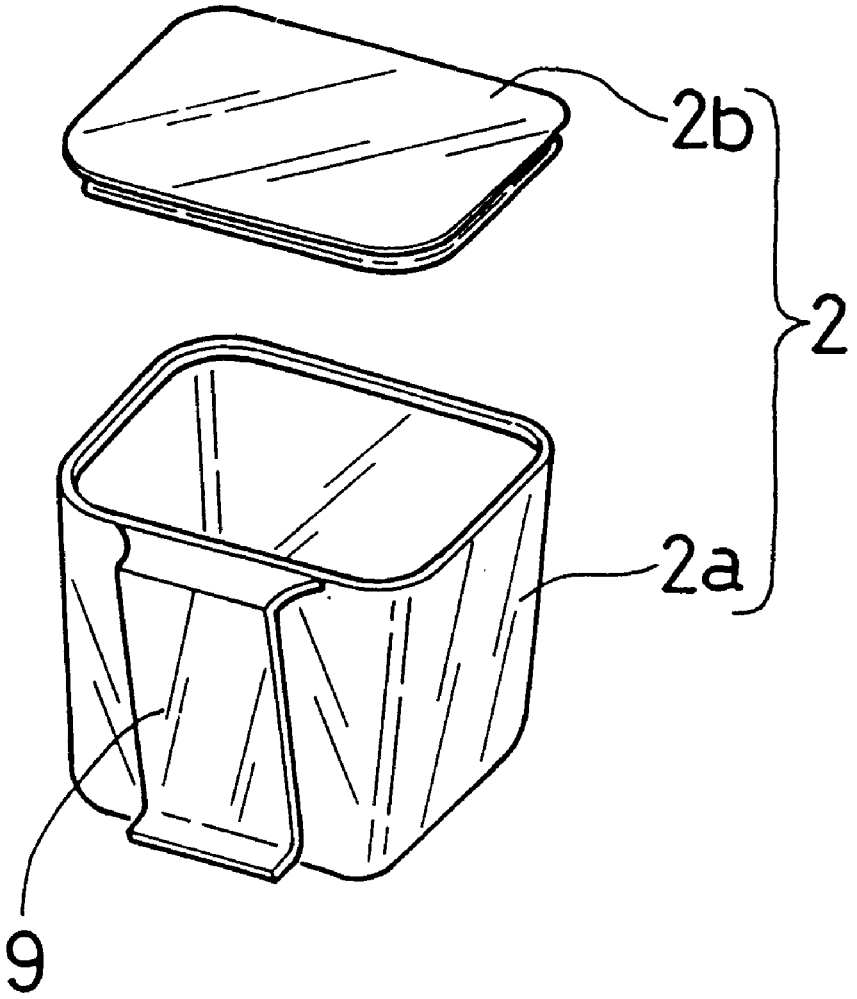
FIG. 19 PRIOR ART
FIG. 19 is a perspective view of an accumulating container.
Figure 20:
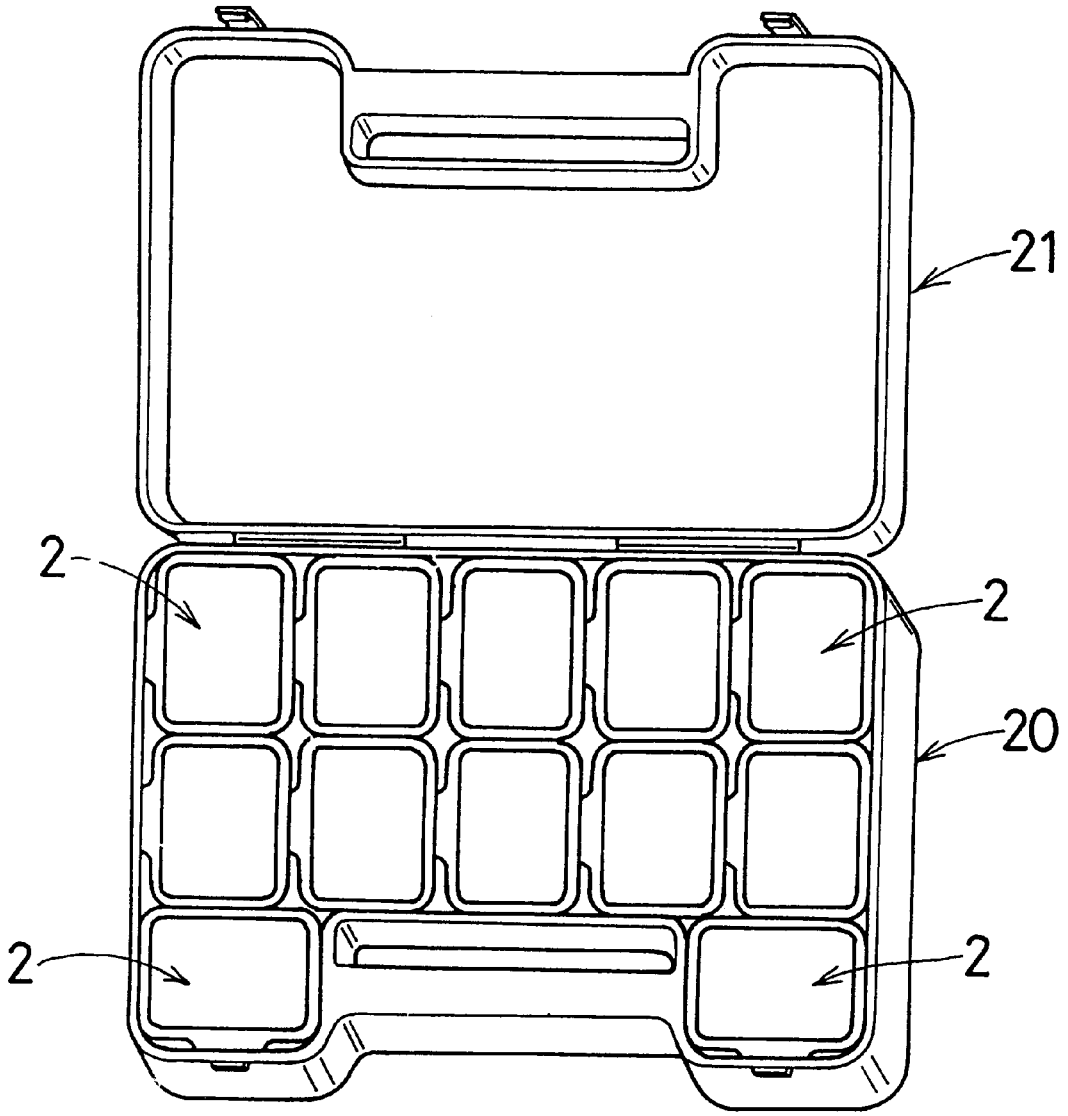
FIG. 20 PRIOR ART
FIG. 20 is a perspective view showing a conventional carrier for accumulating containers with accumulating containers held therein and the lid opened.

While the carrier 1 is a box body having a substantially square shape as shown in FIG. 5, it may alternatively have a flat plate shape, and their shapes may be suitably selected to assume either a rectangular, circular, elliptic or hexagonal shape. The inner surface of the carrier 1 is formed with latticed ribs 4 for reinforcement purposes.

Figure 1:
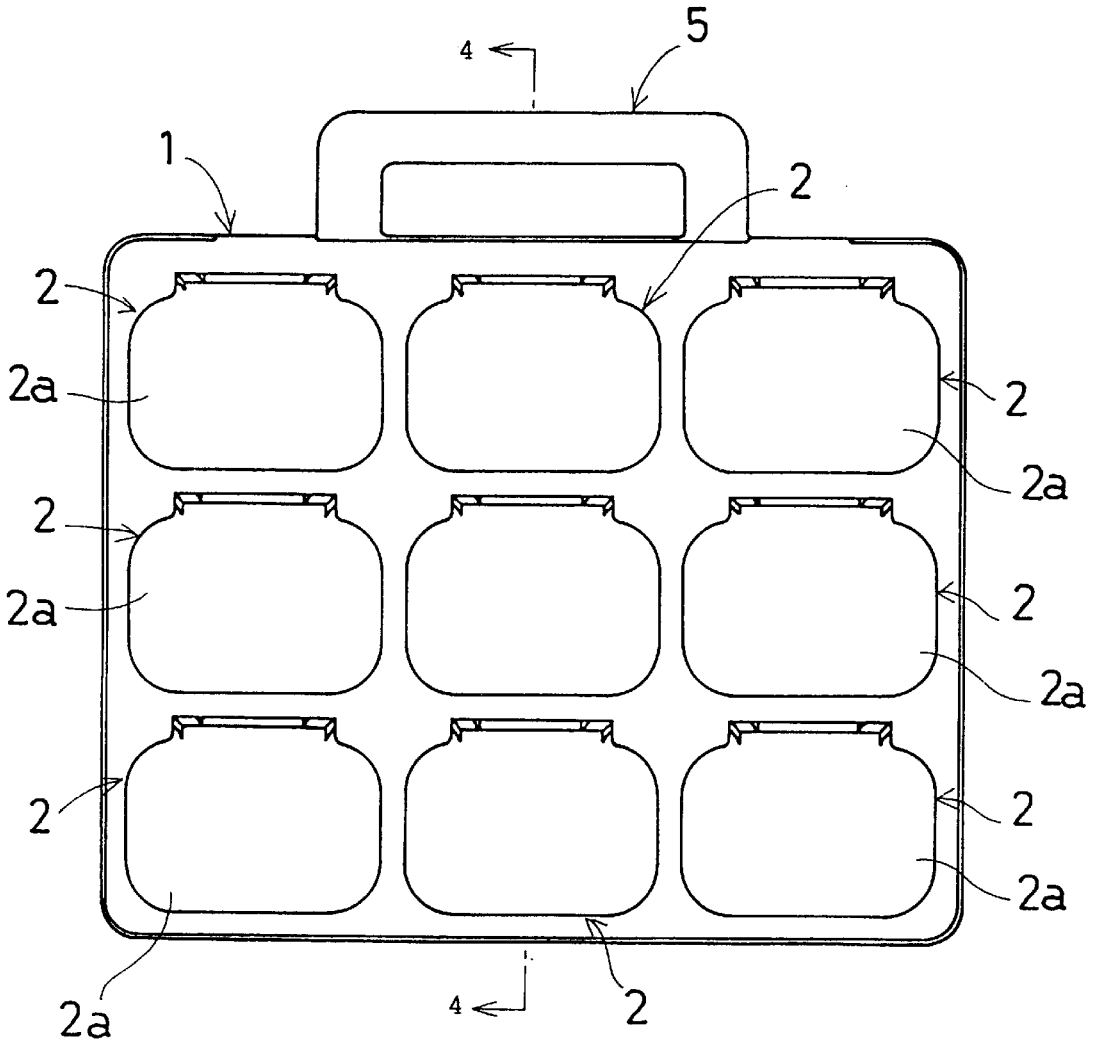
FIG. 1 is a front view of the carrier for accumulating containers according to the present invention with accumulating containers held therein.
Figure 2:
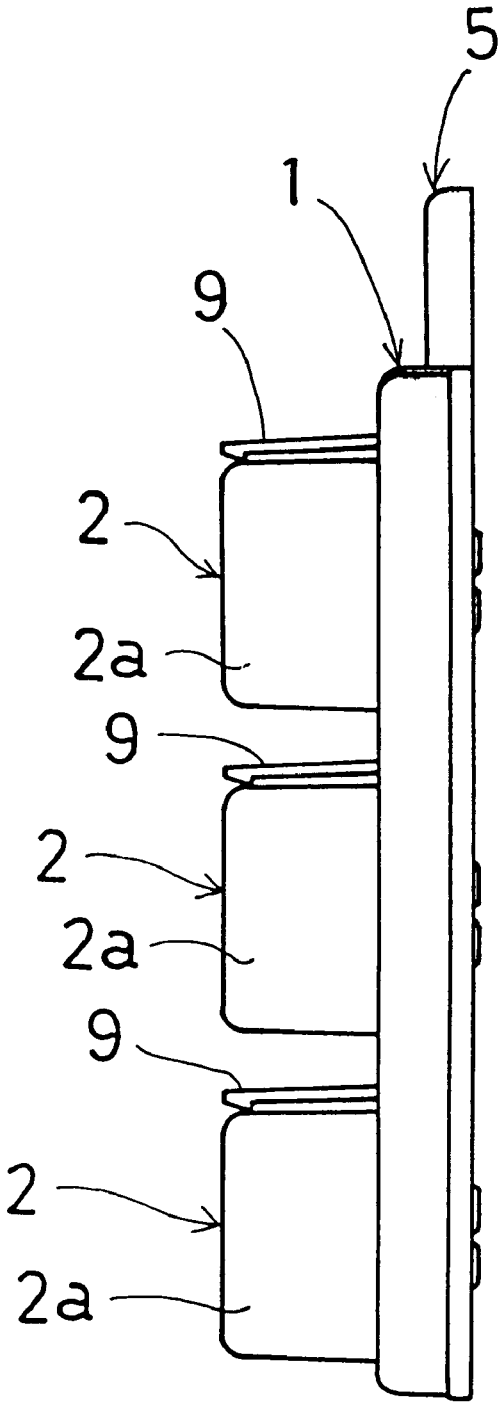
FIG. 2 is a side view thereof.
Figure 3:
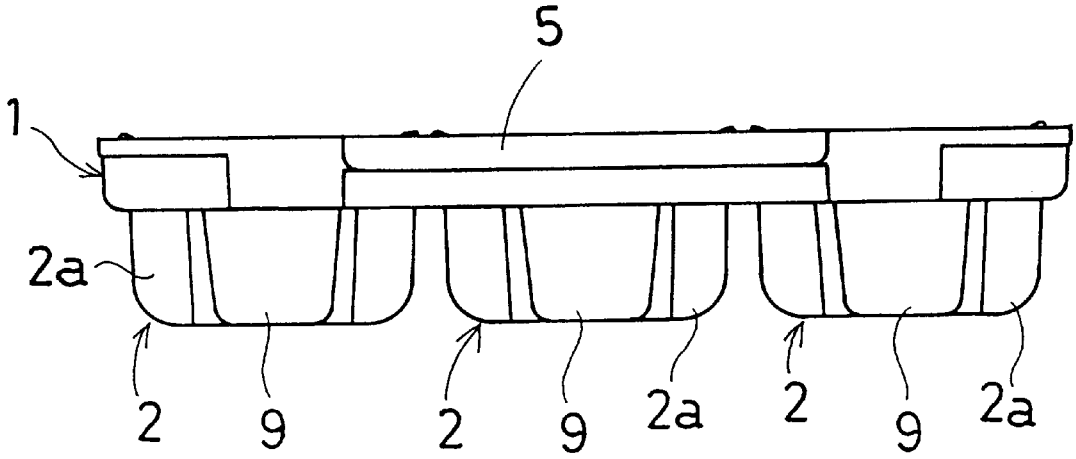
FIG. 3 is a top view thereof.
Figure 4:
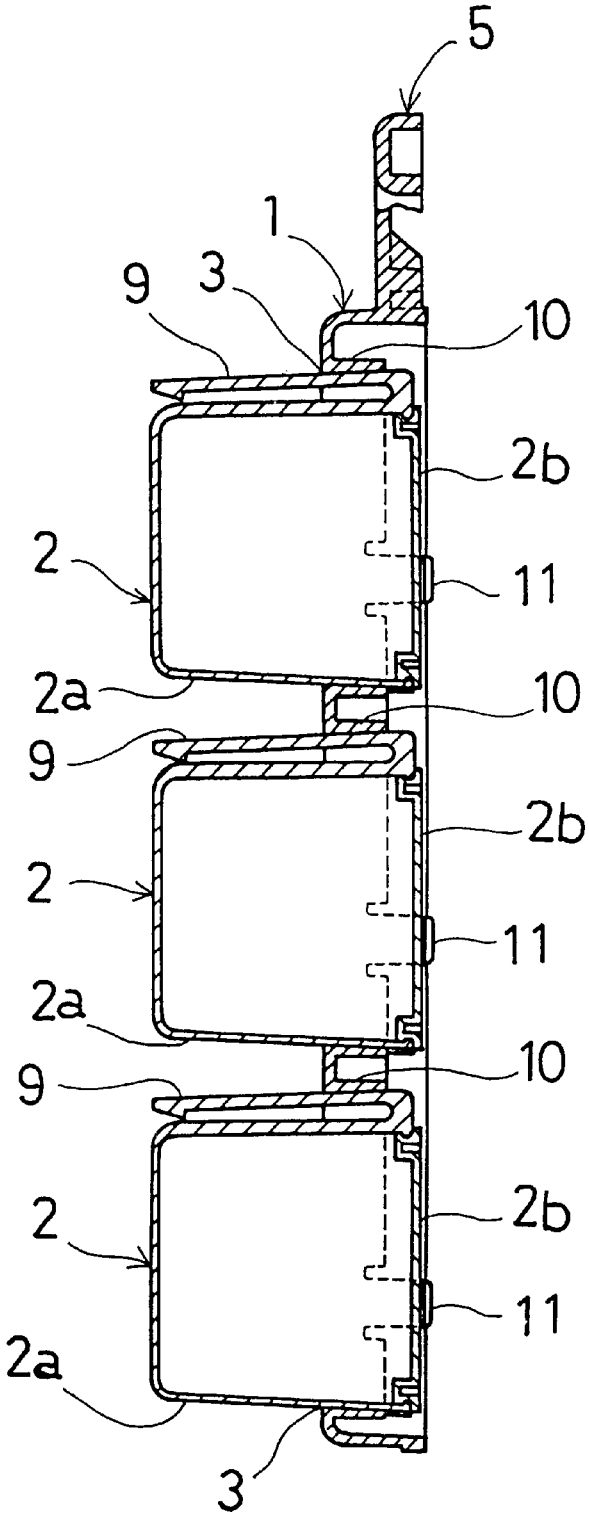
FIG. 4 is a sectional view taken along the line 4—4 in FIG. 1.

A grip 5 is provided in the center of a top portion of the carrier 1 as shown in FIGS. 1.

Further, in the embodiment in which two flat-shaped box shaped bodies 1' are overlapped together, the shapes of box bodies 1' are set to be substantially square as shown in FIG. 5, but they may alternatively assume either a rectangular, circular, elliptic or hexagonal shape; and the inner surface of the side plates 1*b* are respectively formed with latticed ribs 4 so as to reinforce the box bodies 1'.

Also, as shown in FIGS. 10 to 13, there are respectively provided grip forming bodies 5*a* in the center of top portions of the box bodies 1' so that they form a grip 5 when overlapping each other; and an engaging portion 6*a* and an engaging claw 6*b* are formed on lateral sides of the grip forming bodies 5*a* so as to form an engaging element 6 by being engaged to each other.

Additionally, at least one bearing portion 7*a* is provided in an extruding manner at a suitable portion either on the left half or right half in a lower portion of the respective box bodies 1' (it should be noted that two are provided on the left half in the drawings), and at least one pivot portion 7*b* is provided in an extruding manner at a suitable portion on the opposite half portion with respect to the bearing portion 7*a* (it should be noted that two are provided on the right half in the drawings). With this arrangement, the respective aperture sections 1*a* are enabled to be freely opened and closed since the pivot portions 7*b* are respectively supported by the opposing bearing portions 7*a* in a freely rotatable manner.

It should be noted that the grip forming bodies 5*a* are provided with fitting holes 8*a* and fitting projections 8*b*, respectively, for fitting and positioning purposes of the grip forming bodies 5*a* when they are overlapped with each other.

Each of the accumulating containers 2 is formed so that an opening/closing cover 2*b* is made to cover a container main body 2*a* in a freely attachable/detachable manner, and both the container main body 2*a* and the opening/closing cover 2*b* are transparent and somewhat bendable with elasticity. The container main body 2*a* assumes the shape of a cup, that is, a substantially rectangular parallelepiped or substantially cylindrical shape; and if required, a flange (not shown) may be formed on an aperture end thereof. A clip 9 for enabling free attachment/detachment to, for instance, a belt of a pair of trousers is formed on the outer surface of the container main body 2*a*. Further, the outer surface of the accumulating container 2, that is, the outer surface of the container main body 2*a* and the outer surface of the clip 9, assumes a tapered surface expanding from the bottom to the top.

Each of the fitting holes 3 is surrounded by protruding ribs 10, and the inner A surfaces thereof assume tapered surfaces so as to correspond to the outer surfaces of the accumulating containers 2. Further, pressing claws 11 are extruded at suitable portions in upper end edge portions of the ribs 10 so as to press the accumulating containers 2 down onto the carrier 1 (box bodies 1').

When using the carrier for accumulating containers according to the present invention as described above, the main bodies 2*a* of a plurality of accumulating containers 2, which accumulate therein small items, are respectively fitted to fitting holes 3 formed in the carrier 1 (box bodies 1') such that a great part thereof are exposed outward of the carrier 1 (box bodies 1').

By placing the bottoms of the accumulating containers 2 on a mounting surface with the carrier 1 (box bodies 1') in a lying condition, the carrier 1 (box bodies 1') with a plurality of accumulating containers 2 held therein can be stored on a shelf or in a warehouse.

Since the grip 5 is provided in the center of the upper portion of the carrier 1, the carrier can be conveniently moved and stored on a shelf or in warehouse; and when the grip 5 is grasped by hand with the carrier in an upright condition, the carrier 1 is portable and compact, and the carrier can be carried with a plurality of accumulating containers 2 held therein.

The same applies for the case of the second embodiment in which the grip forming bodies 5*a* are provided in the center of upper portions of the box bodies 1', since the carrier can be conveniently moved and stored on a shelf or in a warehouse; and when the grip 5 is grasped by hand with the carrier, which is formed by overlapping aperture sections 1*a* of box bodies 1' with each other, in an upright condition, the box bodies 1' are portable and compact, and the carrier can be carried with a plurality of accumulating containers 2 held therein.

The accumulating containers 2 can be made so as to be transparent and somewhat flexible. In this case, the contents of the accumulating containers 2 are visible while being held in the carrier 1 (box bodies 1'), and the accumulating containers 2 are prevented from detaching from the fitting holes 3 into which they have been fitted.

With the accumulating containers 2 having the tapered outer surfaces and with the carrier that has the ribs 10 whose inner surfaces is tapered so as to correspond to the outer surfaces of such accumulating containers 2, the accumulating containers 2 can be easily fitted to the fitting holes 3 of the carrier 1 (box bodies 1') and held therein in a stable manner.

As described above, in the carrier for accumulating containers according to the present invention, the contents of the accumulating containers 2 can be viewed if the containers themselves are transparent while the carrier 1 (box bodies 1') is not transparent. In addition, the task of determining the contents of the accumulating containers 2 in stored conditions or replacing the accumulated containers 2 with required ones can be made easily. Further, a greater inner volume of the carrier is not required in order to hold a plurality of accumulating containers 2. Therefore, the carrier can be light-weight without being bulky; and since less materials are required, the manufacturing costs can be decreased.

What is claimed is:

1. A carrier for accumulating containers wherein the carrier is formed by two flat-shaped box bodies provided with aperture sections which are overlapped with respect to each other, and a plurality of fitting holes are respectively formed on side plates of the box bodies so that shapes of the fitting holes are substantially identical with sectional shapes of accumulating containers in a periphery of upper end portions of the fitting holes, and wherein the accumulating containers are fitted to the fitting holes of the box bodies such that at least a part of a container main body of each one of the accumulating containers is exposed outward of the box bodies and such that opening/closing covers of opposing accumulating containers are respectively made to be approximate to each other.

2. A carrier for accumulating containers as claimed in claim 1 wherein the accumulating containers are transparent and flexible.

3. A carrier for accumulating containers as claimed in claim 1 wherein ribs are formed in an extruding manner in a periphery of the fitting holes.

4. A carrier for accumulating containers as claimed in claim 3 wherein outer surfaces of the accumulating containers have tapered surfaces that expand from a bottom to a top thereof, and inner surface of the ribs have tapered surfaces so as to correspond to the outer surfaces of the accumulating containers.

* * * * *